US006767121B2

(12) United States Patent
Bost et al.

(10) Patent No.: US 6,767,121 B2
(45) Date of Patent: Jul. 27, 2004

(54) ILLUMINATING OR INDICATING DEVICE OF IMPROVED APPEARANCE, FOR A MOTOR VEHICLE

(75) Inventors: Alain Bost, Bobigny Cedex (FR); Alain Dossot, Bobigny Cedex (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 10/172,385

(22) Filed: Jun. 14, 2002

(65) Prior Publication Data

US 2002/0191412 A1 Dec. 19, 2002

(30) Foreign Application Priority Data

Jun. 18, 2001 (FR) ..... 01 08078

(51) Int. Cl.[7] ..... F21V 5/00
(52) U.S. Cl. ..... 362/521; 362/331
(58) Field of Search ..... 362/321, 520, 362/509, 539, 310, 331, 335, 336, 328, 329

(56) References Cited

U.S. PATENT DOCUMENTS 6,045,246 A 4/2000 Goto ..... 362/521
6,146,004 A 11/2000 Flottmeyer et al. ..... 362/522

FOREIGN PATENT DOCUMENTS

| | | |
|---|---|---|
| DE | 40 05 417 C | 7/1991 |
| DE | 198 04 723 A1 | 8/1998 |
| FR | 2 755 918 | 11/1996 |

OTHER PUBLICATIONS

Patent Abstracts of Japan, Publication No. 07 105705, and Publication Date Apr. 21, 1995.

French Search Report, Feb. 21, 2002.

*Primary Examiner*—John Anthony Ward
(74) *Attorney, Agent, or Firm*—Morgan & Finnegan LLP

(57) ABSTRACT

The invention relates to an illuminating or indicating device for a motor vehicle, including a housing forming a support for at least one light source combined with at least one reflecting surface in order to form an illuminating or indicating beam, enclosing glazing being arranged in front of the light source, and a mask being arranged between the housing and the enclosing glazing in neutral regions of the illuminating or indicating device. According to the invention, only the reflecting surface intended to form an illuminating or indicating beam is metallised or metallic, and the mask is made of transparent material.

7 Claims, 2 Drawing Sheets

ILLUMINATING OR INDICATING DEVICE OF IMPROVED APPEARANCE, FOR A MOTOR VEHICLE

FIELD OF THE INVENTION

The present invention relates to illuminating or indicating devices which are intended to equip motor vehicles.

STATE OF THE ART

Such devices usually include a housing serving for support and positioning of various optical components, such as one or more light sources, one or more reflecting surfaces gathering in the luminous flux emitted by these sources so as to redirect it towards glazing for enclosing and protecting the illuminating or indicating device.

The light sources used in the indicating devices may fulfill several functions: they may, for example, constitute a sidelight, a stop light, a direction-change indicator, a rear fog lamp, etc, several of these functions being capable of being grouped together into the same housing closed off by a single glazing. Likewise, the light sources used in the illuminating devices may fulfill several functions: form main beams, dipped beams, fog lamp beams, and also indicating functions such as a parking light or a direction-change indicator.

The constraints of aerodynamics and the design ideas of the stylists lead to the housing and/or the glazing having shapes which are often very different from those which result solely from technical considerations, while complying with the regulations in force as they apply to illuminating or indicating.

Hence, for example, the glazing of an illuminating and/or indicating device may extend into regions where it no longer has any optical function, but solely an esthetic or aerodynamic role, in a concern for continuity of shapes or of lines with the surrounding bodywork of the vehicle. It is thus usual to arrange in these regions, behind the protective glazing, a mask called "styling" mask, provided with an appropriate coating, for example a reflecting coating, or, in the absence of a mask, to shape or to treat the housing of the illuminating or indicating device, which is then visible behind the protective glazing, so that it has a predetermined appearance, most often bright, obtained by aluminum plating of the mask which is visible through the protective glazing.

The general tendency consists in using a mask or a housing on which a reflecting layer has been deposited by aluminum plating, in front of which is placed colored or uncolored enclosing glazing. If the illuminating or indicating device includes several compartments each fulfilling an illuminating or indicating function, having different regulatory colors, by definition, the result is that the glazing cannot be of the same color in front of these different compartments.

If, particularly for reasons of style, it is desired that the enclosing glazing of a indicating device should exhibit a uniform color in front of the various compartments, one solution consists in using lightly colored glazing, and in arranging, between the light source of each compartment and the glazing, a colored filter of appropriate color with respect to that of the glazing in order, by subtractive synthesis, to obtain a indicating beam of the regulatory color.

All these known solutions give the desired result, but nevertheless exhibit drawbacks. They require one or more surface treatments of the mask or of the housing in order to give them the bright and/or colored appearance. These surface treatments consist of additional manufacturing stages which increase the cost of the finished product due to the substantial scrap rate in the course of manufacture due to defects in appearance. This is because the regions of the enclosing glazing which are not arranged so as to face an illuminating or indicating function are smooth, and leave open to view the slightest defect in metallization or in surface state which the metallization has received, for example heat marks or cavities on this surface.

Moreover, styling considerations are taking on a growing importance these days, and are becoming a major preoccupation as regards the design of motor-vehicle equipment in general, and of headlights or of indicator lights in particular, the motor-vehicle constructors wanting these headlamps or indicator lamps to be characteristic of the vehicle model which they equip, and the designers always seeking new possibilities for aesthetic integration of these illuminating or indicating devices into the vehicle. Hence novel metallization appearances are keenly sought, for example types of nickel/chrome metallization, giving a reflecting coating of a subdued color. These types of metallization are difficult to control, however, and do not give identical results for successive metallizations, and give rise to scrap rates which are too high to be tolerable.

OBJECT OF THE INVENTION

The present invention lies in this context, and its object is to propose an illuminating or indicating device the parts of which, not participating in the production of the illuminating or indicating light beam and visible through the enclosing glazing, have a predetermined color and/or an appearance without exhibiting the drawbacks of the previous technology, that is to say not increasing the time nor the cost of manufacture nor the scrap rate, in a simple way and without disturbing the illuminating or indicating light beam.

DISCUSSION OF THE INVENTION

Hence the subject of the present invention is an illuminating or indicating device for a motor vehicle, including a housing forming a support for at least one light source combined with at least one reflecting surface in order to form an illuminating or indicating beam, enclosing glazing being arranged in front of the light source, a mask or bezel being arranged between the housing and the enclosing glazing in neutral regions of the illuminating or indicating device.

According to the present invention, only the reflecting surface intended to form an illuminating or indicating beam is metallised or metallic, and the mask is made of transparent material.

According to other advantageous and non-limiting characteristics of the invention:

- the mask is made of a colored transparent material;
- the enclosing glazing is colored;
- a colored filter is arranged between the light source and the enclosing glazing;
- the colored filter is of a complementary color to that of the enclosing glazing;
- in neutral regions of the illuminating or indicating device, the mask is arranged at a slight distance from the housing.

Other objects, characteristics and advantages of the present invention will emerge clearly from the description which will now be given of an example given in a non-limiting way with reference to the attached drawings.

DESCRIPTION OF SOME PEFERRED EMBODIMENT OF THE INVENTION

Figure 1:
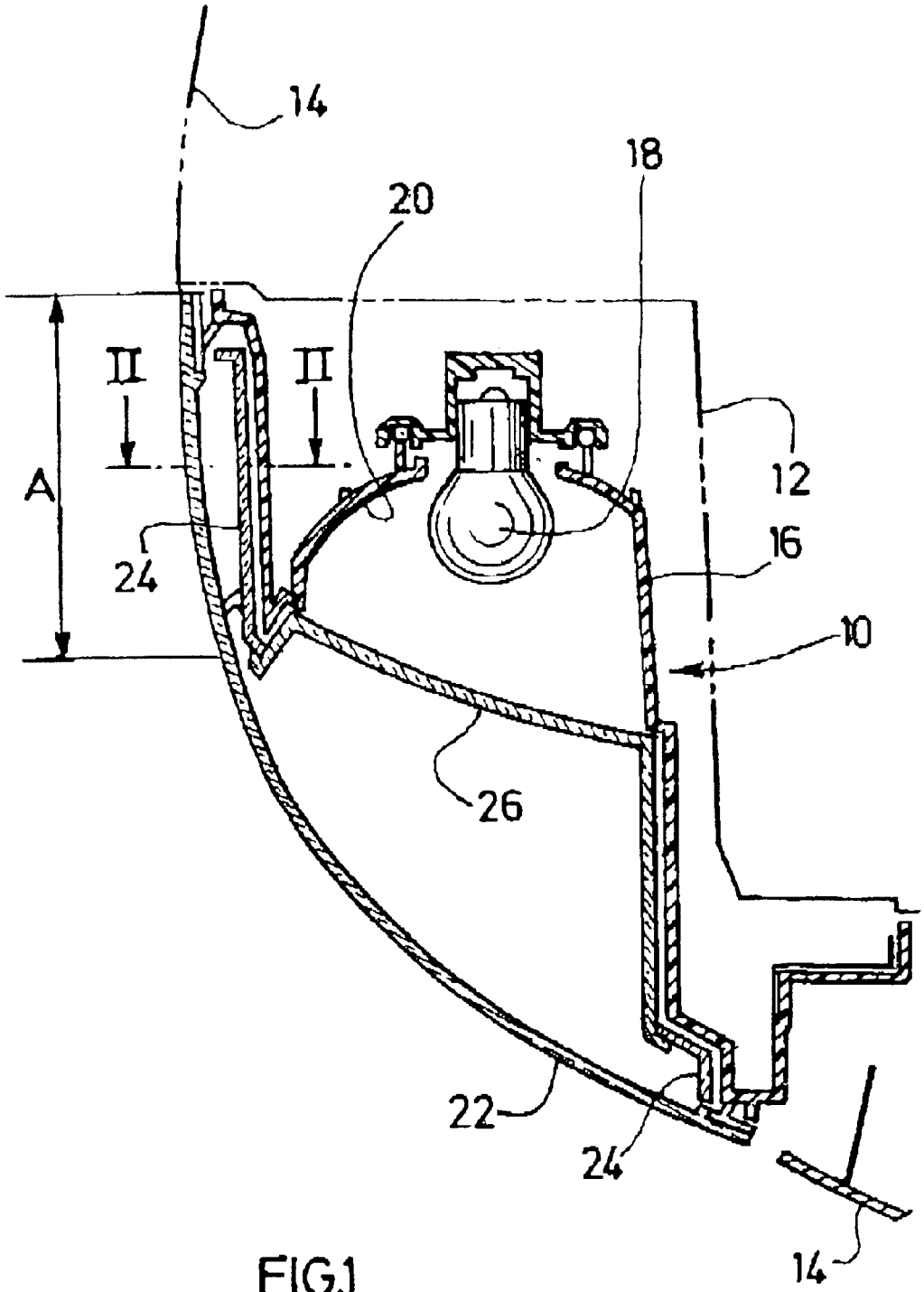
FIG. 1 represents a sectional view of an illuminating or indicating device produced in accordance with the present invention.

In FIG. 1, an indicating device has been represented, designated overall by the reference 10, and intended to be installed in a seating 12 formed in the bodywork 14 of a vehicle. Such an indicating device includes a housing 16, fixed to the vehicle by means which are not represented, and serving as support for various optical components, such as one or more light sources 18, one or more reflecting surfaces 20 gathering in the luminous flux emitted by the sources 18 so as to redirect it towards glazing 22 for closing off and protecting the indicating device 10.

As can clearly be seen in FIG. 1, the enclosing glazing 22 provides continuity of shape and of line with the adjacent bodywork elements 14 of the vehicle. This has the result that regions of the glazing 22, such as A in FIG. 1, have no optical function, and are not traversed by any of the light rays emitted by the source 18. Such regions A, in the present description, are called "neutral areas" of the illuminating or indicating device. An external observer can then perceive the housing 16, through the glazing 22, while, in the other regions, the usual optical elements, such as the light sources 18 and the reflecting surface 20, are visible.

In the case of an indicating device, the reflecting surface 20 is obtained by metallization of the part of the housing 16 situated in the vicinity of the lamp 18, and the shape of which is determined, for example by molding, in order to confer predetermined properties on the light beam reflected by the surface 20. In the case of an illuminating device, the reflecting surface 20 is a metallic surface supported by the housing 16.

It is known to apply various treatments in order to give the part of the indicating device thus visible through the region A of the glazing 22 a predetermined appearance. In this way, the housing 16 itself can be produced from a material of appropriate color, or covered by paint, varnishing or metallization in order to confer on the part which is visible through the region A of the glazing a predetermined appearance, such metallization being obtained at the same time as that of the surface 20. Another alternative consists in arranging, between the glazing 22 and the housing 16, a colored, painted, varnished or metallised mask or bezel 24, in order to hide the part of the housing 16 which is visible through the region A of the glazing 22 and to give the indicating device 10 the desired appearance.

In accordance with the present invention, provision is made to give the indicating device 10 a predetermined appearance without carrying out the additional stages consisting of the surface treatments of the mask and/or of the housing.

According to the invention, provision is made to produce the mask 24 from transparent material, for example polymethylmethacrylate (PMMA) or polycarbonate (PC), so that it leaves the housing 16 visible, the housing generally being produced from plastic such as polypropylene (PP), polycarbonate (PC) or from acrylonitrile butadiene styrene (ABS). Depending on the color of the housing 16 and on that of the transparent mask 24, a colored effect will then result due to the combining of these colors.

Figure 2:
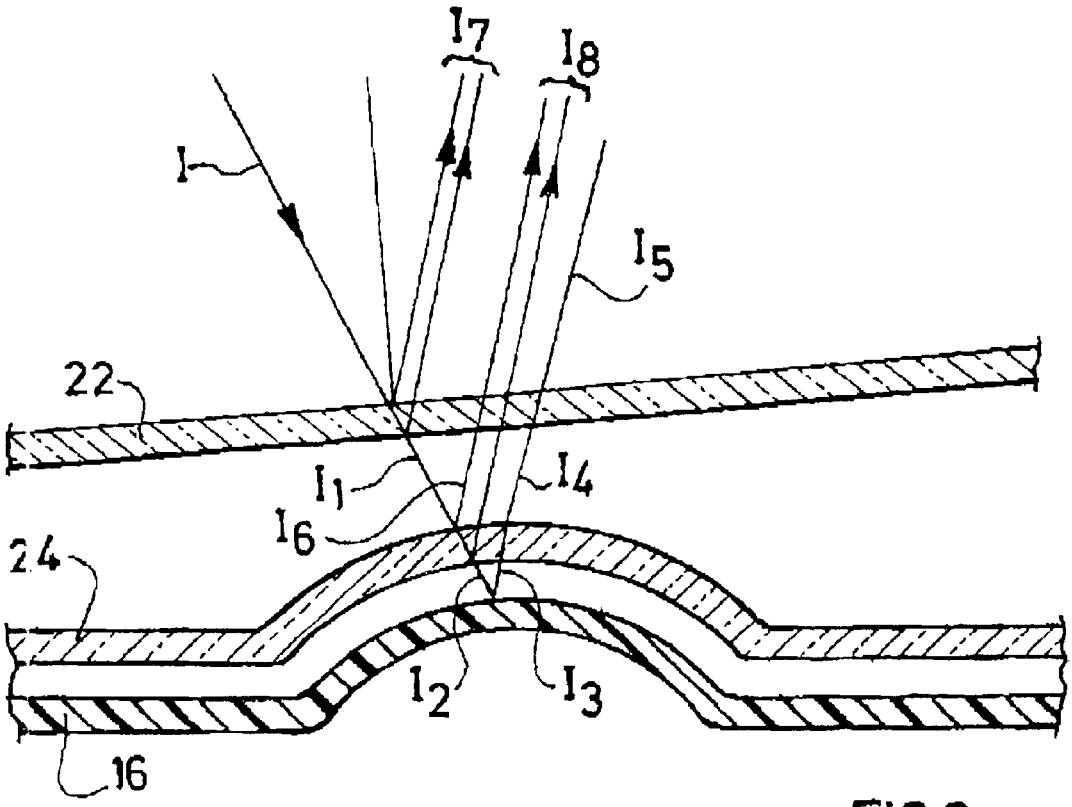
FIG. 2 represents a sectional view on a larger scale along the line II—II of FIG. 1, and showing the routing of the light rays.

In FIG. 2 has been represented, diagrammatically, a sectional view of the indicating device of FIG. 1, in the region A of the glazing 22. In this figure can be seen a light beam I incident on this region A of the glazing of the indicating device. The beam I generally consists of the natural light of day, white in color, or of artificial light, close to white light. This beam passes through the glazing 22, then the transparent mask 24, so as to arrive at the housing 16, made of opaque material. It is then reflected by the housing 16, and it again passes through the transparent mask 24, then the glazing 22, so as to emerge from the indicating device where it can be perceived by the eye of an observer. In the region A at least, the housing 16 has a surface state known by the name of "polished mirror", so as to obtain specular reflection of the light rays incident on it.

Under these conditions, it will be understood that the light beam $I_2$, after having passed through the transparent mask 24, no longer consists of white light, but contains only wavelengths determined by the color of the transparent mask 24. The beam $I_3$, reflected and diffused by the wall of the housing 16, in its turn contains only wavelengths determined by the color of the transparent mask 24 and by that of the surface of the housing 16 turned towards the mask 14. The beam $I_3$ is then transmitted integrally by the transparent mask 24, and by the glazing 22 so as to form the emerging beam $I_5$.

An observer then perceives the beam $I_5$, at the same time as the beam $I_6$ passing through the glazing 22 and resulting from the reflection of the beam $I_1$ on the transparent mask 24. There is then combining of the colors of these two beams in order to form a beam of a third color, close to that of the transparent mask 24.

It is also possible to make provision to use colored glazing 22 so as to obtain a wider variety of colored effects. So that the colored glazing 22 does not disturb the photometry of the indicating beam generated by the lamp 18, it is possible to make provision to arrange, between the lamp 18 and the glazing 22, a colored filter 26 of a color complementary to that of the glazing 22 in order, by subtractive synthesis, to obtain a light beam of the desired color.

In contrast, in the region A of the glazing of the indicating device, the color of the glazing 22 could be combined with those of the mask 24 and of the housing 16.

As has been represented in FIG. 2, the light beam I, of white light, incident on the region A of the glazing of the indicating device, is reflected by the colored glazing 22 so as to form the beam $I_7$, and it passes through it, forming the colored beam $I_1$. The beam $I_1$ is reflected by the mask 24 so as to form the beam $I_6$, which passes through the colored glazing 22 so as to form the beam $I_8$. The beam $I_1$ also passes through the transparent mask 24, so as to form the beam $I_2$, which arrives on the housing 16, made of opaque material. It is then reflected by the housing 16 so as to form the beam $I_3$ which again passes through the transparent mask 24 so as to form the beam $I_4$, then the glazing 22 so as to form the beam $I_5$ emerging from the indicating device, where it can be perceived by the eye of an observer.

Figure 3:
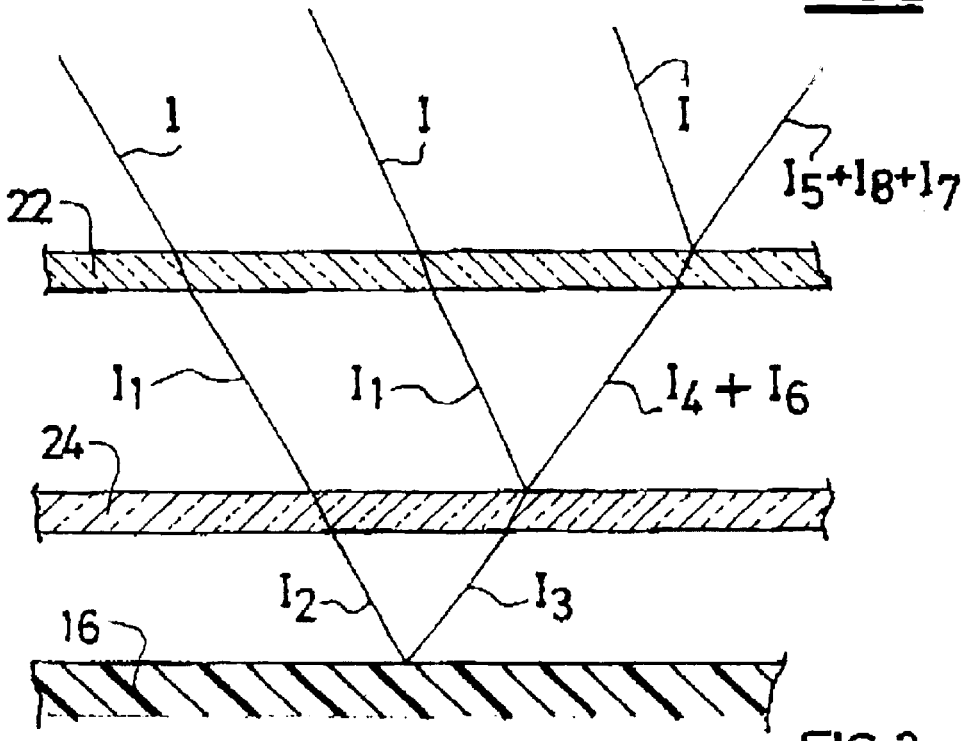
FIG. 3 represents a view similar to that of FIG. 2, and showing the routing of the various incident light rays which give an emerging ray.

This observer then perceives the beam $I_5$, at the same time as the beams $I_7$ and $I_8$. There is then combining of the colors of these three beams so as to form a beam of a fourth color, as has been represented in FIG. 3.

The results which are of the most interest are obtained when, in the neutral areas A of the indicating device, the mask 24 is arranged at a slight distance from the housing 16, in such a way that the mask 24 follows the shapes, concave and convex, of the housing 16, as has been represented in FIG. 2. The observer then has the impression of an absence of mask, and that the housing itself has received a particular surface treatment. For example, in the case of a housing which is black in color, a mask which is red in color and glazing of a pink color, the observer has the impression that, in the neutral areas of the illuminating or indicating device, the mask has received nickel/chrome metallization followed by red varnishing.

Depending on the colors of the glazing 22, of the mask 24 and of the housing 16, it will be possible to obtain an illuminating or indicating device the parts of which not participating in the deriving of the illuminating or indicating light beam, and visible through the enclosing glazing, are of a predetermined color.

Needless to say, the present invention is not limited to the embodiments which have been described, but, in contrast, the person skilled in the art could apply numerous modifications to it which fall within its scope. In this way, having been described more particularly in relation with an indicating device, the present invention applies in the same way to the neutral areas of an illuminating device, in which the enclosing glazing is uncolored, in general. The colors of the mask and of the housing could then be chosen outside color constraints related to indicating.

What is claimed is:

1. Illuminating or indicating device for a motor vehicle, comprising a housing forming a support for at least one light source combined with at least one reflecting surface in order to form an illuminating or indicating beam, enclosing glazing arranged in front of the light source and a bezel arranged between the housing and the enclosing glazing in neutral regions of the illuminating or indicating device, wherein only the reflecting surface intended to form an illuminating or indicating beam is metallised or metallic, and the bezel is made of transparent material.

2. A device according to claim 1, wherein the bezel is made of a colored transparent material.

3. A device according to claim 1, wherein the enclosing glazing is colored.

4. A device according to claim 3, wherein a colored filter is arranged between the light source and the enclosing glazing.

5. A device according to claim 4, wherein the colored filter is of a complementary color to that of the enclosing glazing.

6. A device according to claim 1, wherein in neutral regions of the illuminating or indicating device, the bezel is arranged at a small distance from the housing.

7. An automobile comprising the illuminating or indicating device of claim 1.

* * * * *